United States Patent [19]

Meinecke et al.

[11] 4,207,144

[45] Jun. 10, 1980

[54] PAPERMAKING MACHINES

[75] Inventors: Albrecht Meinecke; Heinrich Zag, both of Heidenheim, Fed. Rep. of Germany

[73] Assignee: J. M. Voith, GmbH, Heidenheim, Fed. Rep. of Germany

[21] Appl. No.: 2,319

[22] Filed: Jan. 10, 1979

Related U.S. Application Data

[63] Continuation of Ser. No. 840,920, Oct. 11, 1977, abandoned.

[30] Foreign Application Priority Data

Oct. 20, 1976 [DE] Fed. Rep. of Germany ..... 2647295

[51] Int. Cl.[2] ..... D21F 1/36; D21H 1/06

[52] U.S. Cl. ..... 162/304; 162/300; 162/352

[58] Field of Search ..... 162/132, 133, 203, 217, 162/300, 301, 303, 304, 306, 264, 351, 352, DIG. 7

[56] References Cited

U.S. PATENT DOCUMENTS

| | | | |
|---|---|---|---|
| 3,201,305 | 8/1965 | Webster | 162/303 X |
| 3,726,758 | 4/1973 | Parker et al. | 162/301 X |
| 3,772,140 | 11/1973 | Kobayashi | 162/133 |
| 3,876,498 | 4/1975 | Justus | 162/301 X |
| 3,985,612 | 10/1976 | Watanabe | 162/303 X |
| 4,055,461 | 10/1977 | Turunen | 162/301 X |

FOREIGN PATENT DOCUMENTS

| | | | |
|---|---|---|---|
| 2557146 | 9/1976 | Fed. Rep. of Germany | 162/300 |

*Primary Examiner*—Richard V. Fisher
*Attorney, Agent, or Firm*—Lon H. Romanski

[57] ABSTRACT

A papermaking machine is shown with an inner traveling screen and an outer traveling screen which are led towards each other to form a generally layered arrangement therebetween during a region of their joint travel and, in such region, the inner and outer screens are caused to pass over a portion of a water extracting or dewatering roller; a water collection apparatus situated outside of the roller serves to collect water centrifuged from the screens passing over the roller; and a preliminary water extraction zone preceeds the roller and such zone extends over a portion of, for example, a generally horizontal section of the inner screen.

18 Claims, 4 Drawing Figures

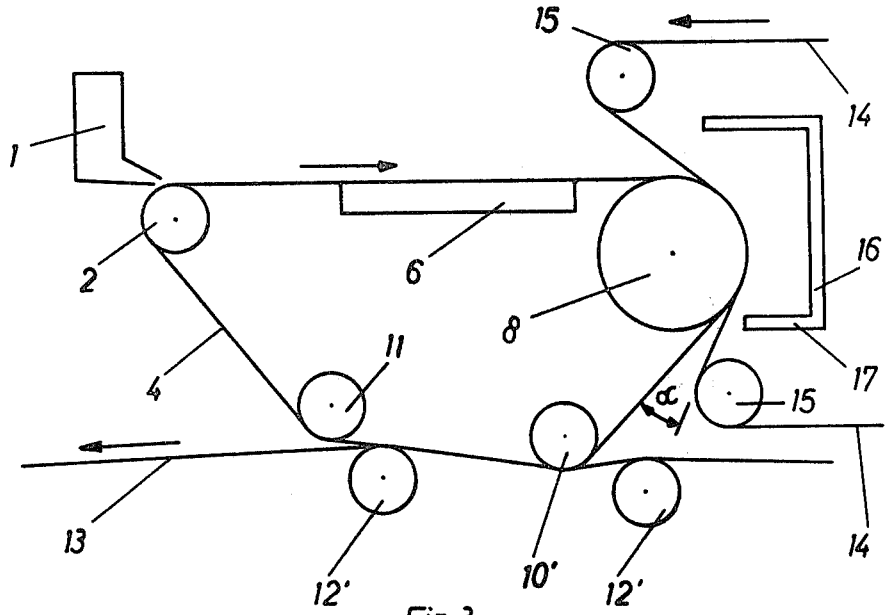
Fig.3
Fig.4
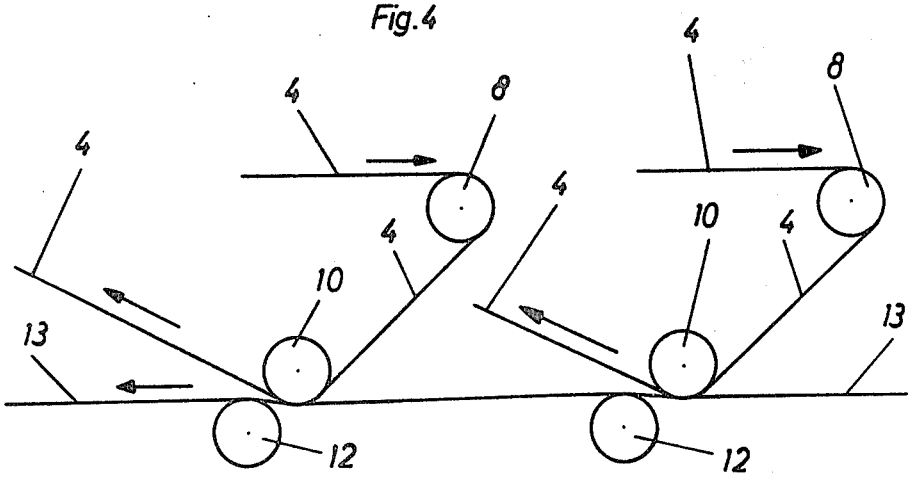

PAPERMAKING MACHINES

This is a continuation of application Ser. No. 840,920, filed Oct. 11, 1977, now abandoned.

BACKGROUND OF THE INVENTION

In the case of papermaking machines according to the invention, a generally inward water extraction is attained as on a horizontal screen section of the inner screen upstream of the subsequent dewatering roller means while, as both inner and outer screens pass over the dewatering roller means a generally outward water extraction, in a direction functionally opposite to the inward water extraction, is attained. Consequently, a paper thusly produced has approximately the same paper properties on both sides.

The fibre suspension obtained through the passage of the material onto the inner screen already has most of the water extracted on the horizontal screen section of the inner screen which action is normally intensified as by suction boxes placed beneath such horizontal screen section. However, as to subsequent additional extraction of water, the prior art, heretofore, has considered it sufficient if the paper web was merely subjected to a change of direction. For example, in the prior art, it was only thought possible to attain a more substantial water extraction through measures of positive or negative pressurization as, for instance, through suction boxes beneath the horizontal inner screen section as in the Federal Republic of Germany patent specification No. 2,411,739 or through water-removal scrapers positioned after the roller as in Federal Republic of Germany Published patent specification No. 2,226,029. This teaching and belief by the prior art applies to both high-speed and slow-running papermaking machines; that is, in the case of high-speed machines a great deal of water is already flung out with a small turning of the paper web as a result of the high centrifugal forces, while with slow-running machines only a little water is expelled and, in the opinion of the experts in the prior art, in both cases only longer suction boxes or a greater vacuum in the horizontal screen section of the inner screen were worthy of consideration for an intensification of the water extraction.

In the case of the papermaking machine taught by and disclosed in the said German patent specification No. 2,411,739 the roller has a perforated shell from which the two screens run off together still within the enveloping upper roller quadrants.

After running off the roller water appears on both the inner and the outer screens and such water has to be removed by a plurality of scrapers. The outer screen exhibits a particularly large quantity of water as a result of the water being driven outwards of the roller through the screen tension and centrifugal force. A part of such water is indeed flung off; however, the remainder of the water is collected on and carried by the outer screen. In such prior art arrangements, water is also flung back onto the inner screen from the perforations of the roller shell. The comparatively large quantity of residual water on the screens downstream of the roller results in an undesirable re-moistening of the paper web. Further, the scrapers normally inflict some wear on the screens and, given the slightest irregularity in either their shape or in the screens, severe damage to these sensitive screens occurs.

In the case of the papermaking machine taught in the said German patent specification No. 2,226,029 the roller shell is likewise perforated. Through this a large part of the water extracted from the paper web is held in the inner screen and such water is subsequently removed from the inner screen by scrapers that are disposed after the roller.

It is the object of the invention to solve the prior art problem of attaining a greater extraction of water without the incorporation of costly devices and without enlarging the bulk of the machine, and this even when the machine is operated with a relatively slow web speed, and wherein the rollers can be inexpensive to produce and the problems associated with the prior art scrapers can to be avoided.

SUMMARY OF THE INVENTION

Generally, a papermaking machine, in accordance with the invention, has its roller provided with an imperforate roller shell. With a papermaking machine being so constructed it becomes possible for exceptionally high quantities of water to be removed from the paper web compared to the known prior art structural forms, and thus high dry contents are attained. This could be explained as follows; that is, because the roller shell is imperforate, no water is able to pass out of the fibrous web through the inner screen in the direction of the roller shell within the envelopment zone. As a result of the screen tension, water flows in the other direction in this zone, that is outwards, and is thrown off the outer screen through centrifugal force. The roller is inexpensive to produce, since it is not perforated. Further, it is also possible to dispense with the scrapers mentioned, with all their disadvantages.

An important advantage of the invention is that, while heretofore in the case of papermaking machines with preliminary water removal the water extraction on the water extraction roller was too small, it is now possible to attain a balanced ratio between the quantity of water removed in the preliminary water extraction zone and that removed on the water extraction roller.

U.S. Pat. No. 3,876,498 teaches the use of a forming cylinder, with an imperforate shell, in a machine in which substantially different conditions prevail; that is, in that machine the suspension is enclosed in the gap which two screens running on the forming roller constitute between them. In that arrangement the inner screen runs onto the forming cylinder before it is coated with fibrous suspension and the enveloped part of the forming cylinder constitutes the sole water extraction path or zone of the paper web being formed. Further, such a prior art papermaking machine is used only for comparatively high web speeds. The use of an imperforate cylinder shell of the said U.S. patent is only to improve the separation of the two screens. The advantages attained with the present invention are neither sought nor attained by apparatus constructed in accordance with the teachings of said U.S. patent.

The point at which a screen leaves the roller can be critical in the case of the invention. That is, the centrifugal force would be thought to come into effect; however, instead of that a vacuum is built up in the wedge-shaped gap occurring downstream of the point of leaving at which the screen leaves the roller shell, which, in turn, seeks to suck the water in the undesired direction, namely, towards the roller shell. Consequently, according to one preferred form of embodiment of the invention the point at which the two screens leave the roller is located in the lower half of the roller, so that the residual water (which at the point of leaving the roller shell is substantially to be found in the zone of the outer screen through the action of centrifugal force) is flung downwards. In this way a re-moistening is avoided.

In one particular form of the invention, first the outer screen runs off the lower half of the roller, and then the inner screen. Consequently, a particularly simple machine construction is attained.

If, as in another embodiment of the invention, both screens run off the roller together and are separated from one another on a screen separating surface with a convex curvature (a guide or another roller) disposed downstream of the roller, then in a simple way a longer path is obtained over which any residual water that may still be present can drip off the outer screen.

It is also possible, with a papermaking machine constructed in accordance with the teachings of the invention, for a guide with a convex curved surface to be disposed before the roller, over which the inner screen is guided onto the roller, when the radius of curvature of the guiding surface is greater than the radius of the roller shell. Such a guide provides a gentler pressure transition for the water extraction pressure alternating from inwards to outwards at this point, through which the reduction of fine material on the outside of the paper is influenced. The content of fine material on the outside of the paper affects its appearance and adhesive capacity, which is of significance especially in the production of cardboard, in which several layers have to be couched together. In the simplest form or embodiment of such an arrangement could consist in the sliding surface of the guide disposed before the roller being a surface impenetrable by water.

In another aspect of the invention an influence upon the water extraction is attained through the outer screen not being led first onto the roller, but instead first over the sliding surface of the guide on the inner screen or on the paper web lying thereon. For a given radius of the sliding surface and the roller, the screen tension of the outer screen substantially determines the severity of the water extraction.

The screen water removal device beneath the substantially horizontal screen section of the inner screen preceding the roller preferably contains suction boxes, as generally known in the art, and/or water scraper bars (foils). One particular application of the invention is in machines for the production of multi-layer papers or cardboard, with which a plurality of papermaking units are disposed above a common belt (screen or felt) receiving the individual webs one after another, wherein at least one of which is formed in a manner in accordance with the invention.

Various general and specific objects, aspects and advantages of the invention will become apparent when reference is made to the following detailed description considered in conjunction with the accompanying drawings.

BRIEF DESCRIPTION OF THE DRAWINGS

FIGS. 2 and 3 are respectively schematic side views of two further embodiments of the invention; and FIG. 4 is a schematic side view of a machine, for the production of multi-layer paper or cardboard, with two papermaking units embodying teachings of the invention.

DETAILED DESCRIPTION OF THE PREFERRED EMBODIMENT

Figure 1:
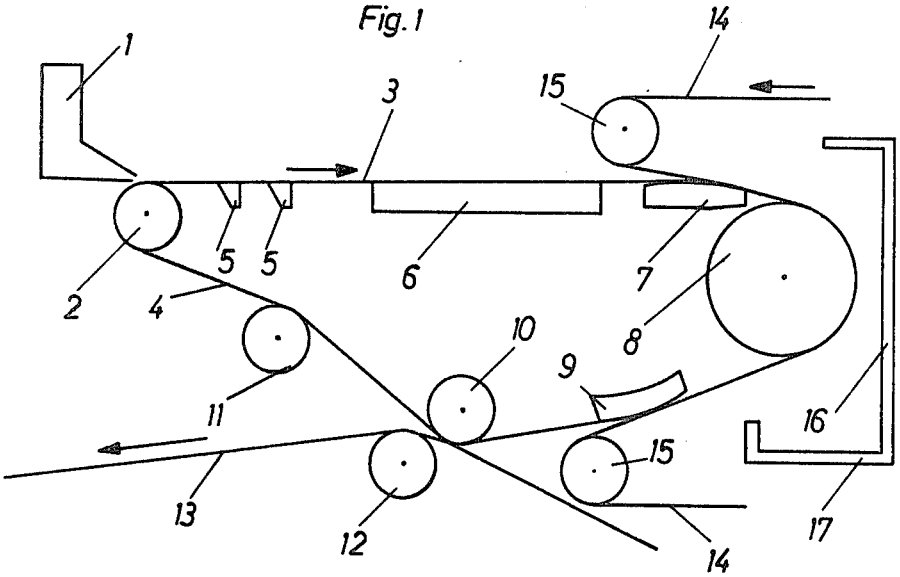
FIG. 1 is a schematic side view of a papermaking machine embodying teachings of the invention.

In FIG. 1 a material feed 1, in the vicinity of an upper guide roller 2, is directed onto the substantially horizontal screen section 3 of an inner screen 4. Under the horizontal screen section 3 there are, for example, two scrapers 5 and a suction box 6 serving for the removal of water. After this, the inner screen 4 runs over the curved sliding surface of a guide 7 and then over a roller 8 (hereinafter referred to as a "forming roller" in order to more readily distinguish it) with an imperforate shell. If in viewing FIG. 1, the forming roller 8 is considered as having a vertical axis and horizontal axis passing through the center thereof, such axes will define two upper arcuate areas of quadrants of the rotating forming roller 8 and two lower arcuate areas or quadrants of the rotating forming roller 8. In the preferred embodiment, as depicted, the inner screen 4 and the outer screen 14 would leave the forming roller 8 in the first of the two lower quadrants with such first lower quadrant being that lower quadrant first traversed by the inner screen 4 in the lower half of the forming roller. Thereafter, the inner screen 4 passes over a suction box 9, a dandy roll 10 and a further guide roller 11 back to the upper guide roller 2. The web lying on the inner screen 4 is passed on to a receiving belt 13 (screen or felt) between the dandy roll 10 and a couching roller 12 located generally opposite thereto. An outer screen 14, that is led over guide rollers 15, passes onto the guide surface 7 and onto the paper web carried by the inner screen 4 from which it leaves after the forming roller 8 and as at the suction box 9. On the periphery of the forming roller 8 the more water centrifuged through the outer screen 14, the smaller is the diameter of the forming roller 8; consequently, it should be comparatively small, and in any case be smaller than the radius of curvature of the sliding surface of the guide 7. In the zone in which the forming roller 8 flings off water there is disposed a water collector 16, the sump of which 17 extends as far as, for example, the screen-separation suction box 9, so that it can also collect water dripping from the screen.

instead of the suction box 9 serving for the screen separation it is also possible to provide a guide with a curved sliding surface, on which the two screens 4 and 14 are separated from one another. The directions of movement of the two screens 4 and 14 and the belt 13 are indicated by related arrows.

Figure 2:
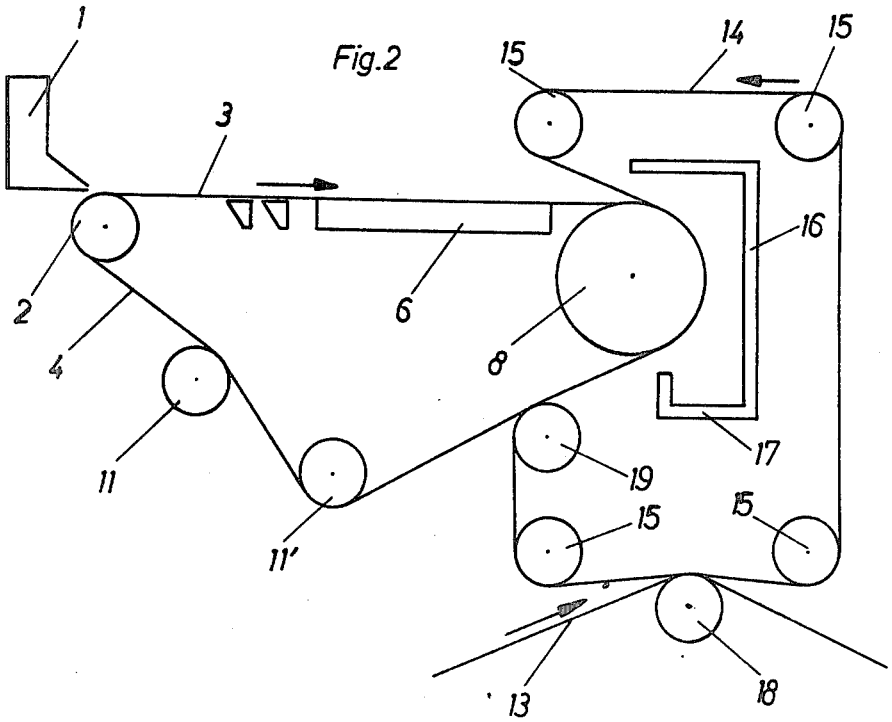

In FIG. 2 parts and/or elements which are same or similar to those of FIG. 1 are provided with the same reference numbers. The difference from FIG. 1 is that a second guide roller 11' is provided instead of the dandy roll 10 of FIG. 1. The transfer of the paper web is effected here from the outer screen 14 onto the belt 13 by means of a roller 18, which preferably has an imperforate shell. A sucker or a roller 19 (suction roller or a roller with an imperforate shell) serves for separation of the web from the inner screen 4.

In FIG. 3 parts and/or elements which are same or similar to those of FIG. 1 are again provided with the same reference numbers. Reference should be made to the description above for the manner of working. In FIG. 3 the two screens 4 and 14 are already separated from one another at the forming roller 8. As already mentioned, it is possible for a region of underpressure to exist at the point where the outer screen 14 leaves the forming roller 8 shell, through which, again, underpressured water can be sucked back inwards out of the outer screen 14 and into the web carried on the inner screen 4. In order to centrifuge this water completely off the web of the inner screen 4 again, provision is made here for the inner screen 4, and the web thereon, to be taken a determined distance further around the forming roller 8 than the outer screen 14. The leaving point of the outer screen 14 and that of the inner screen 4 advantageously lie so far apart that the two sections of screen running off include an angle $\alpha$ of at least 5° between them. The transfer of the paper web from the inner screen 4 to the belt 13 is effected by means of three rollers 10' and 12' having imperforate shells.

As FIG. 4 shows, by means of sections of two machine units as in FIG. 1, one or more papermaking units can be disposed over a common belt 13 (screen or felt), on which the individual webs are deposited and are bonded together into multilayer paper or cardboard.

We claim:

1. A papermaking machine, comprising inner screen means movable in a first closed loop path, other screen means movable in a second closed loop path, a portion of said first closed loop path comprising a generally horizontal path traversed by said inner screen means, means defining a preliminary water extraction zone situated generally along said generally horizontal path and effective for removing a preliminary amount of water from material carried by said inner screen means therepast, said means defining a preliminary water extraction zone comprising suction box means situated generally adjacent said inner screen means and below said generally horizontal path, rotatable dewatering roller means comprising a generally cylindrical imperforate roller shell, said first and second closed loop paths being such as to lead said inner and outer screen means together posterially to said preliminary water extraction zone and over and against a portion of the arcuate periphery of said imperforate roller shell, said inner and outer screen means first operatively engaging said imperforate roller shell at an area thereof at least near the arcuate top thereof, water collecting means disposed externally of said imperforate roller shell for collecting such water as is centrifuged from said screen means passing over and against said portion of said imperforate roller shell, said first and second closed loop paths being such as to cause said inner and outer screen means to leave said imperforate roller shell at a point in the lower half of said roller shell, and guide means disposed generally anteriorly to said imperforate roller shell, said guide means comprising a convex curved sliding surface, said guide means and said sliding surface being so positioned as to result in said inner screen means sliding thereacross as to thereby be led onto said imperforate roller shell, said curved sliding surface having a radius of curvature greater than the radius of curvature of said imperforate roller shell, said first and second closed loop paths also being such as to cause said inner screen means to carry thereagainst said outer screen means as said inner screen means passes over and against said sliding surface.

2. A papermaking machine according to claim 1 wherein said first and second closed loop paths are such as to cause said inner and outer screen means to leave said imperforate roller shell in the first of the two lower quadrants of said imperforate roller shell with said first quadrant being that lower quadrant first traversed by said screen means in the lower half of said roller shell.

3. A papermaking machine according to claim 2 wherein said first and second closed loop paths are also such as to cause said outer screen means to first leave said imperforate roller shell and to cause said inner screen means to subsequently leave said imperforate roller shell.

4. A papermaking machine according to claim 3 wherein said outer screen means and said inner screen means leaving said imperforate roller shell define an included angle therebetween in the order of magnitude of at least five degrees.

5. A papermaking machine according to claim 1 wherein said first and second closed loop paths are also such as to cause said outer screen means to first leave said imperforate roller shell and to cause said inner screen means to subsequently leave said imperforate roller means.

6. A papermaking machine according to claim 5 wherein said outer screen means and said inner screen means leaving said imperforate roller shell define an included angle therebetween in the order of magnitude of five degrees.

7. A papermaking machine according to claim 1 wherein said first and second closed loop paths are such as to cause said inner and outer screens means to leave said imperforate roller shell as to still be together, and further comprising separating surface means of at least a convex configuration, and wherein said first and second closed loop paths also are such as to cause said inner and outer screen means still together to pass operatively against said separating surface means where separation of said outer screen means from said inner screen means is achieved.

8. A papermaking machine according to claim 7 and further comprising second guide means, and wherein said separating surface means comprises a convex surface portion carried by said second guide means.

9. A papermaking machine according to claim 7 and further comprising screen roller guide means, and wherein said separating surface means comprises an outer cylindrical surface carried by said roller guide means.

10. A papermaking machine according to claim 1 wherein said sliding surface is impenetrable by water.

11. A papermaking machine according to claim 1 wherein said preliminary water extraction zone comprises water removal means, and wherein said water removal means comprises water scraper bars.

12. A papermaking machine according to claim 1 and further comprising closed loop belt means leading to associated paper processing means, wherein said material causes a paper web to be formed generally between said inner and outer screen means, wherein said inner and outer screen means separate from each other after traveling together for a preselected distance on and about said imperforate roller shell, wherein said paper web remains on one of said screen means after said inner and outer screen means so separate from each other, and wherein after said inner and outer screen means so separate said paper web is transfered to said belt means.

13. A papermaking machine according to claim 12 and further comprising second inner screen means movable in a third closed loop path, second outer screen means movable in a fourth closed loop path, a portion of said third closed loop path comprising a second generally horizontal path traversed by said second inner screen means, additional means defining a second preliminary water extraction zone situated generally along said second generally horizontal path and effective for removing a preliminary amount of water from second material carried by said second inner screen means therepast, said additional means defining a second preliminary water extraction zone comprising additional suction box means situated generally adjacent said second inner screen means and below said second generally horizontal path, second rotatable dewatering roller means comprising a second generally cylindrical imperforate roller shell, said third and fourth closed loop paths being such as to lead said second inner and outer screen means together posterially to said second preliminary water extraction zone and over and against a portion of the arcuate periphery of said second imperforate roller shell, said second inner and outer screen means first operatively engaging said second imperforate roller shell at an area thereof at least near the arcuate top thereof, wherein said second material causes a second paper web to be formed generally between said second inner and said second outer screen means, wherein said second inner and second outer screen means separate from each other after traveling together for a preselected distance on and about said second imperforate roller shell, wherein said second paper web remains on one of said second screen means after said second screen means so separate from each other, and wherein after said second screen means so separate said paper web is transfered to said belt means.

14. A papermaking machine according to claim 13 wherein said second inner screen means comprises said one of said second screen means.

15. A papermaking machine according to claim 12 wherein said one of said outer screen means comprises said one of said screen means.

16. A papermaking machine according to claim 1 wherein said first and second closed loop paths are such as to cause said outer screen means to meet the inner screen means as said inner screen means passes over said sliding surface.

17. A papermaking machine according to claim 16 wherein said sliding surface is impenetrable by water.

18. A papermaking machine, comprising inner screen means movable in a first closed loop path, outer screen means movable in a second closed loop path, a portion of said first closed loop path comprising a generally horizontal path traversed by said inner screen means, means defining a preliminary water extraction zone situated generally along said generally horizontal path and effective for removing a preliminary amount of water from material carried by said inner screen means therepast, said means defining a preliminary water extraction zone comprising suction box means situated generally adjacent said inner screen means and below said generally horizontal path, rotatable dewatering roller means comprising a generally cylindrical imperforate outer roller surface, said roller means being situated as to have the uppermost arcuate portion of said outer roller surface at an elevation substantially lower than the elevation of said generally horizontal path, guide means disposed generally posteriorly to said suction box means and anteriorly to said imperforate outer roller surface, said guide means comprising a convex curved sliding surface which has a radius of curvature greater than the radius of curvature of said imperforate outer roller surface, said guide means and said sliding surface being so positioned with respect to each other as to have the uppermost portion of said curved sliding surface generally tangential to said generally horizontal path and at an elevation substantially above the elevation of said uppermost arcuate portion of said imperforate outer roller surface, said guide means and said sliding surface being so positioned as to result in said inner screen means sliding thereacross as to subsequently be led onto said imperforate outer roller surface, said first and second closed loop paths being such as to lead said outer screen means operatively against said inner screen means as said inner screen means slides across said sliding surface to thereby have said inner screen means and said outer screen means together as said inner and outer screen means pass beyond said sliding surface and onto over and against a portion of the arcuate pwriphery of said imperforate outer roller surface, said first and second screen means upon passing onto said imperforate outer roller surface first operatively engaging said imperforate outer roller surface at an area thereof at least near the arcuate top thereof, and water collecting means disposed radially outwardly of said imperforate roller surface for collecting such water as is centrifuged from said screen means passing over and against said portion of said imperforate outer roller surface.

* * * * *